United States Patent [19]

Szabo

[11] 4,189,216

[45] Feb. 19, 1980

[54] OPTICAL SYSTEM FOR PHOTOGRAPHIC COMPOSING APPARATUS

[75] Inventor: Francis S. Szabo, Morristown, N.J.

[73] Assignee: AM International, Inc., Los Angeles, Calif.

[21] Appl. No.: 585,610

[22] Filed: Jun. 10, 1975

Related U.S. Application Data

[63] Continuation-in-part of Ser. No. 523,557, Nov. 14, 1974, Pat. No. 3,968,501.

[51] Int. Cl.[2] ..... B41B 13/00

[52] U.S. Cl. ..... 354/7; 354/5; 354/10; 354/15

[58] Field of Search ..... 354/5, 8, 9, 10, 15, 354/7; 350/40, 42

[56] References Cited

U.S. PATENT DOCUMENTS

| | | | |
|---|---|---|---|
| 2,454,686 | 11/1948 | Back | 350/40 |
| 2,670,665 | 3/1954 | Caldwell | 354/13 |
| 2,699,101 | 1/1955 | Ferguson et al. | 354/17 |
| 3,074,328 | 1/1963 | Rossetto et al. | 354/17 |
| 3,094,050 | 6/1963 | Higonnet et al. | 354/7 |
| 3,106,880 | 10/1963 | Rossetto et al. | 354/7 |
| 3,118,354 | 1/1964 | O'Brien | 354/12 |
| 3,218,945 | 11/1965 | O'Brien et al. | 354/7 |
| 3,433,559 | 3/1969 | Vockenhuber et al. | 350/42 |
| 3,434,402 | 3/1969 | McCall | 354/5 |
| 3,509,804 | 5/1970 | Kohler | 354/17 |
| 3,552,285 | 1/1971 | McCall | 354/10 |
| 3,602,116 | 8/1971 | Moyroud | 354/15 |
| 3,668,984 | 6/1972 | Rosin | 354/10 |
| 3,687,025 | 8/1972 | Rosin | 354/5 |
| 3,742,825 | 7/1973 | Shapiro | 354/9 |
| 3,747,484 | 7/1973 | Purdy et al. | 354/15 |
| 3,909,832 | 9/1975 | Booth | 354/5 |
| 3,914,774 | 10/1975 | Griffith | 354/5 |

*Primary Examiner*—L. T. Hix
*Assistant Examiner*—Alan Mathews
*Attorney, Agent, or Firm*—Allegretti, Newitt, Witcoff & McAndrews

[57] ABSTRACT

An optical system for photocomposing. A variable aerial image is supplied to the focal plane of a collimating lens couple, wherein the decollimating lens is used for composition escapement.

8 Claims, 5 Drawing Figures

OPTICAL SYSTEM FOR PHOTOGRAPHIC COMPOSING APPARATUS

This is a continuation-in-part of U.S. application Ser. No. 523,557, filed Nov. 14, 1974 in the name of Barry D. Gilbert for "PHOTOCOMPOSITION MACHINE WITH IMPROVED LENS CONTROL SYSTEM," now U.S. Pat. No. 3,968,501, issued July 6, 1976.

The specification is completed, by instruction in positioning the lens by computer control for point size change, as set forth and claimed in an application by Thomas A. Booth, Ser. No. 562,886, LENS SYSTEM FOR PHOTOCOMPOSITION MACHINE, now abandoned.

BACKGROUND OF THE INVENTION

The present invention, which might better be termed a discovery, can be fully comprehended when viewed in the light of the historical development of the photocomposition art. This background discussion is not a comprehensive treatise on all such development, but that which will show the area neglected, into which the present invention falls.

The broad term "photocomposition" can be applied even to the quite ancient art of portrait and snapshot photography. One making an exposure of film in a camera, and wishing to make a print other than the exact size of the film negative from the camera, may place that film negative into a projection device, generally termed an enlarger, and then adjust the distance of the film holder from the sensitive paper holder, and "focus" the picture by moving the lens relative to the film and paper.

The photocomposition term is generally now applied to the setting of printing text for cold type. The term will be used in that sense hereinafter. In order to produce a line of text, the photocomposition machine establishes a font holder plane and a sensitive film or paper plane. These two are not alterable in distance, as in a photo enlarger. Hence, early phototypesetting machines produced print in one size only, which was established by the distance between the font and paper, and the particular lens situated to project the image.

Early in the development of the art, it became apparent that the point size of the projected image could best be changed by changing the lens, rather than supplying a different size font source. By 1950, an application was made which ultimately issued as U.S. Pat. No. 2,790,362 for a machine employing a turret arrangement whereby multiple lenses were made available for the purpose of providing multiple point size projection. There may have been earlier teachings, but this is one of those teaching changeable lenses.

About the same time in the development of phototypesetting, the placement of type across the page began to receive considerable attention. Either the photosensitive sheet had to be moved laterally in order to position the characters in the composition one after the other, or the projected beam was required to be diverted across the page. Both approaches had considerable following. Beam diverting has been done by physically transporting the font, and by beam deflection. Deflecting of the beam has been developed to a fine degree of perfection in order that the physical mass of the paper holder or the projection device could be avoided.

With the development of various means to place the characters across a column of composition, came the development of means to space proportionally between letters and words. Proportional spacing is done to justify a column for the purpose of producing a pleasing uniform margin on left- and right-hand sides of the column. Much development attention has been given to this portion of photocomposition.

Another means for placing the letters along a row of composition was taught by U.S. Pat. No. 2,670,665. This teaching was of a collimating lens placed such that its focal plane was at the plane of the image font. Thus, the lens projects a column beam which is unintelligible until intercepted by another lens known as a decollimating lens. Because such decollimating lenses are lighter in weight than the paper or font carriages, a lens carriage shiftable the length of a desired printing column is easily moved in an escapement path back and forth the width of the printing column. The decollimating lens is coupled with a diverting mirror or prism to project the image into a focal plane laterally of the carriage movement path.

This escapement concept produced good placement of the images and did it quite rapidly, but taught no point size change concept.

Therefore, one is left with the inescapable conclusion that if the collimating escapement concept is to be employed, the collimating lens must be manually changeable. A turret of changeable lenses might be employed to swing into position if somehow the turret of lenses could be arranged such that the focal length of each lens would fall on the same font image plane. This is not a problem with the ancillary teaching of the developments taking place, because the turret lens concept being taught were focusing lenses not collimating lenses.

The turret concepts have always suffered from alignment problems in that the turret is a mechanical device and exact placement of the lens by the turret cannot be precisely precalculated but must be manually adjusted to position correctly during manufacture.

SUMMARY OF THE INVENTION

The advantage of this invention is that an infinite number of point sizes, in full and fractional part, is made available to meet requirements of magnetic ink recognition size (9.095 pt. E13B) and the various optical code recognition (OCR) fonts.

It is an object of this invention to provide the infinite number of point sizes in rapid sequence when changes are made, and with no lens alignment concern.

This invention, or discovery, was made by observing the advantage of the prior art U.S. Pat. No. 2,670,665 in the simplified escapement concept, but finding no logical means for applying the turret of U.S. Pat. No. 2,790,362. It was then conceived that by supplying an aerial image rather than a real image and moving the collimating lens to position the collimating lens focal plane on that aerial image, then the projected image size could be changed rapidly and to any desired degree. This, it was observed, would not effect the decollimating escapement mechanism because a collimated beam is theoretically projectable to infinity and may be refocused at any position along its beam. Accordingly, there is sufficient room for moving the collimating lens to produce the focused image of any size aerial image provided.

Then, in order to provide a rapidly changeable aerial image, this invention supplied a rotating font as in the prior art patent, but provided a focusing lens in the manner of a photographer's enlarger lens, which is known by the term "variator" lens.

Finally, it may be summarized that this invention provides upon the prior art background the improvement of projecting an image from a character font through a lens which will produce an aerial image of selectable, variable size whereafter the aerial image is collimated by a collimating lens. The collimating lens is positioned such that its focal plane is on the plane of the selectable size produced by the first lens. Finally, the collimated beam is decollimated and projected onto a sensitive sheet in the manner taught by the prior art.

Having developed the concept of invention as thus far described, this inventor in conjunction with a co-inventor developed a lens control system in order to position the various described lenses by a programmed system which not only enables the operator of the photocomposition machine to indicate a point size, together with other variables, but have the selected lenses compensated for focal length tolerances. That is, if perfect lens were used, the proper relative positioning of the variator lens and the collimating lens could be placed in a computer memory for use by a control program. However, any reasonable priced lens for a commercial machine is not perfect. This inventor and the co-inventor have developed a system for fitting lenses to a machine and a program to carry out the basic concept set forth above. That application was filed in the United States Patent Office as Ser. No. 562,886 on Mar. 28, 1975.

The drawings of Ser. No. 562,886 and the text thereof, together with the foregoing emphasis on the variable point size production, will provide a complete teaching. Therefore, the following "Description of the Preferred Embodiment" is a copy of the prior specification Ser. No. 562,886 except for the Abstract, Background, and Summary.

BRIEF DESCRIPTION OF THE DRAWINGS

The many advantages of this invention will be readily appreciated as the same becomes better understood by reference to the following detailed description when considered in connection with accompanying drawings, in which like reference numerals designate like parts throughout the figures thereof and wherein.

DESCRIPTION OF THE PREFERRED EMBODIMENT

Figure 1:
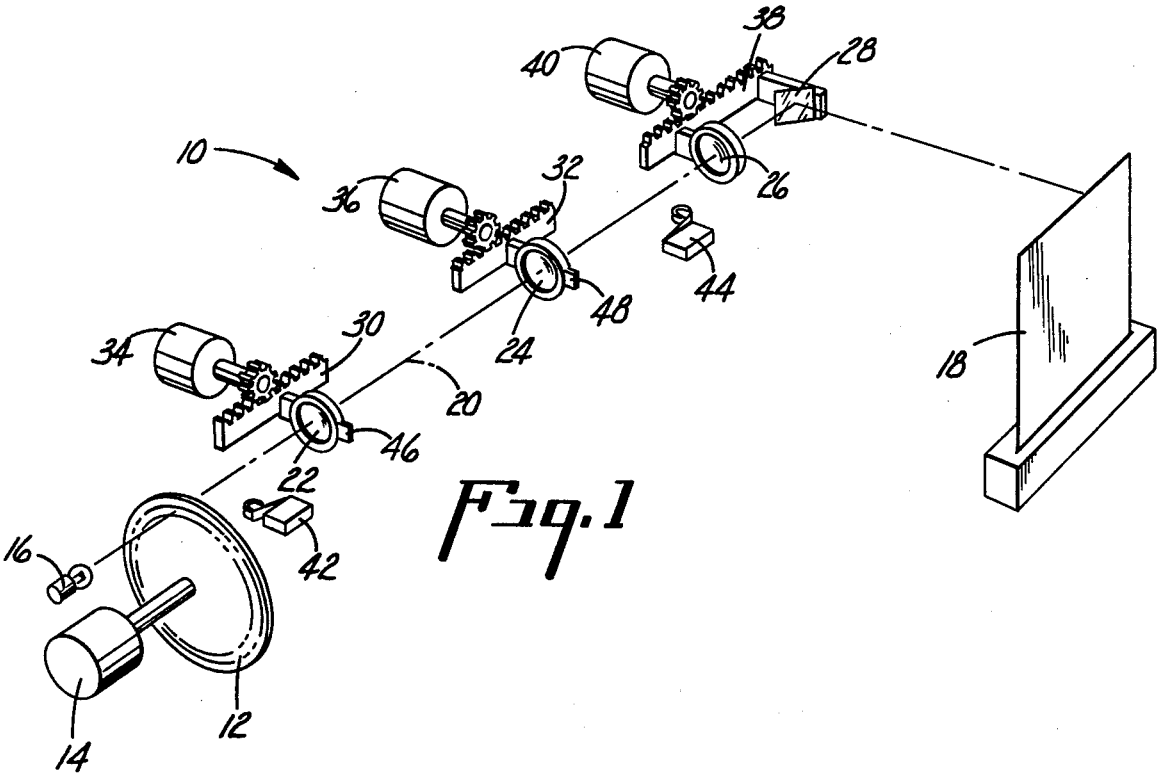
FIG. 1 is a simplified perspective view of the lens system associated with the present invention.

Referring now, more particularly, to FIG. 1 of the drawings, the optical system associated with the present invention is generally indicated by the numeral 10 and includes a character storage disc 12 which is rotated by a drive motor 14. Preferably the disc is of a conventional type and contains various alphanumeric characters which are defined by transparent areas, not illustrated. A conventional flash lamp 16 or other appropriate light source projects a selected character image through the lens system onto a photosensitive film or tape indicated by the numeral 18. Each time flash lamp 16 is energized, such produces a character image which is projected along a path generally indicated by the numeral 20. The image is received by variator lens 22 and projected into collimator lens 24. The light column from the collimating lens is parallel and does not come to a focus. Focussing is achieved by decollimating lens 26.

Variator and collimator lenses 22 and 24 are mounted to carriages 30 and 32, respectively, which are controlled by stepper motors 34 and 36, or other appropriate drive means. Decollimator lens 26 and mirror 28 are mounted to a third carriage 38, which is controlled by a stepper motor 40. Carriage 38 is moved laterally of the photosensitive member 18, whereby the selective characters are spaced across the photosensitive member to provide a composed line of type. Since the distance between the decollimator lens 26 and photosensitive member 18 remains constant, the movement of carriage 38 does not affect focussing of the image.

Focussing as well as magnification is controlled by the respective positions of the variator and collimator lenses 22 and 24. Position command signals are provided to stepper motors 34 and 36 which move the lenses in position for proper magnification and focussing, as hereinafter described. When utilizing stepper motors, the position command data is provided in terms of motor steps from some reference positions. The reference positions are defined by home position switches 42 and 44 or other sensing means associated with the variator and collimator lenses, respectively. These may be conventional micro-switches having actuators positioned for engagement by tab members associated with the lenses, such as those indicated at 46 and 48. It is not intended that the present invention be limited to this particular lens arrangement. Other types of lenses, such as zoom lenses, may be utilized if desired. Also, the lens carriages may be controlled to various mechanical linkages, such as worm drives, and drive means other than stepper motors may be utilized, if desired.

Figure 2:
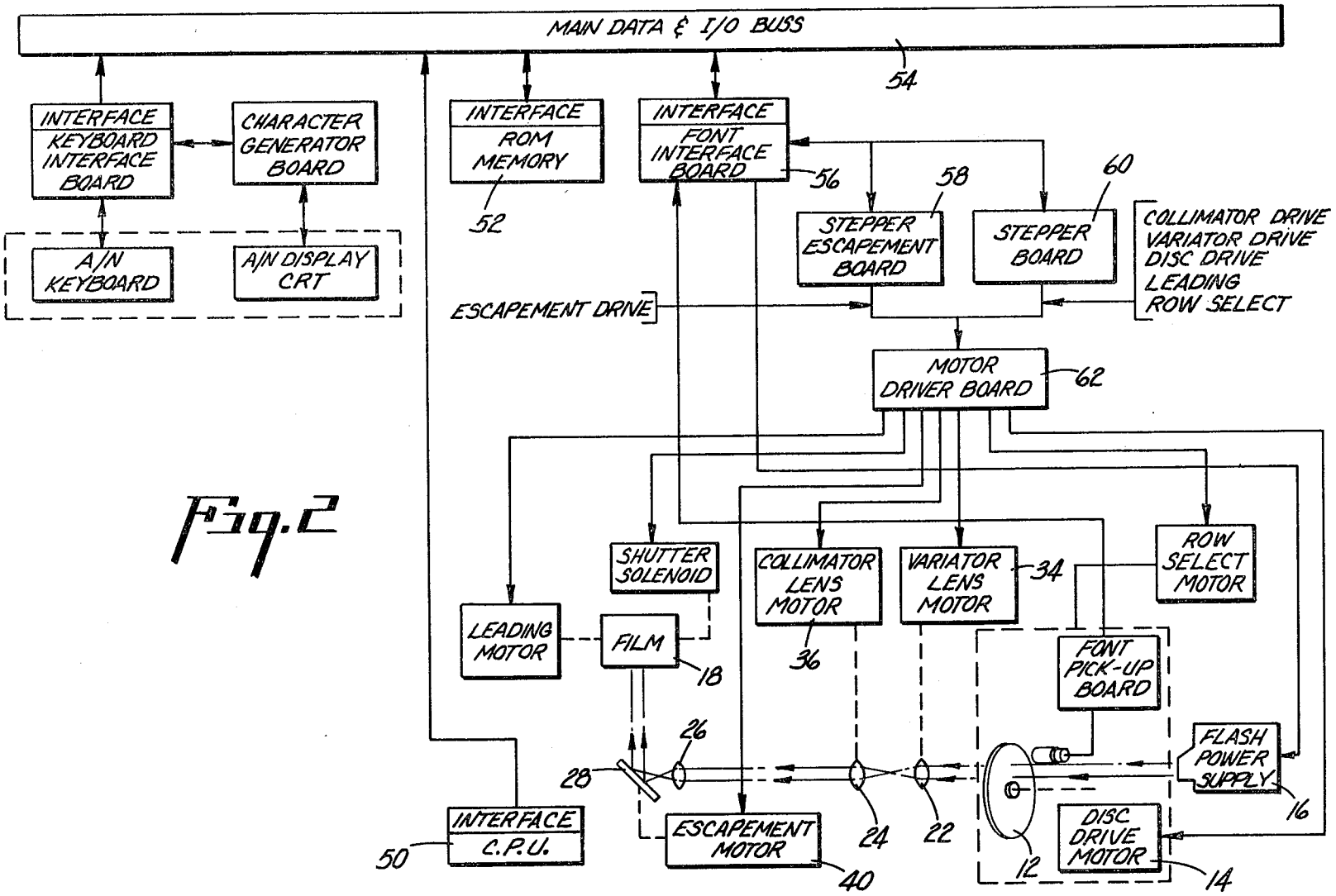
FIG. 2 is a block diagram of a typical control system associated with the present invention.

Referring to FIG. 2, appropriate means for controlling the lens positions is illustrated in simplified block diagram form. This system is described in detail in the co-pending patent application Ser. No. 523,558, now abandoned. Control of the system is provided by an appropriately programmed central processing unit (CPU) 50 and read only memory (ROM) 52 containing an application program. The CPU may be a commercially available microprocessor, such as the Intel Corp. No. 8008 Microprocessor. The CPU together with ROM 52 provide handling of all input commands and type character key strokes selected by the machine operator. Several other functions are also carried out under control of the processor including the various commands controlling the stepper motors and the flashing of selected characters. These commands are handled through data buss 54 and Font Interface Board 56 to a Stepper Escapement Board 58 and Stepper Board 52. The Stepper Escapement Board contains the logic to control carriage 38 upon receipt of input command data from the CPU. Control logic registers and controls for the collimator and variator stepper motors are contained on Stepper Board 60. Position control signals from the Stepper Board and Stepper Escapement Board are provided to a Motor Driver Board 62, which converts the signals to higher voltage and current values for proper operation. The control signals provided through Boards 60 and 62 may be described as position command data which is representative of the number of steps which a motor is to be driven. With the type of control system illustrated in FIG. 2, the variator and collimator lenses are moved by position command data which is a function of the selected character image size and determined system parameters.

Figure 5:
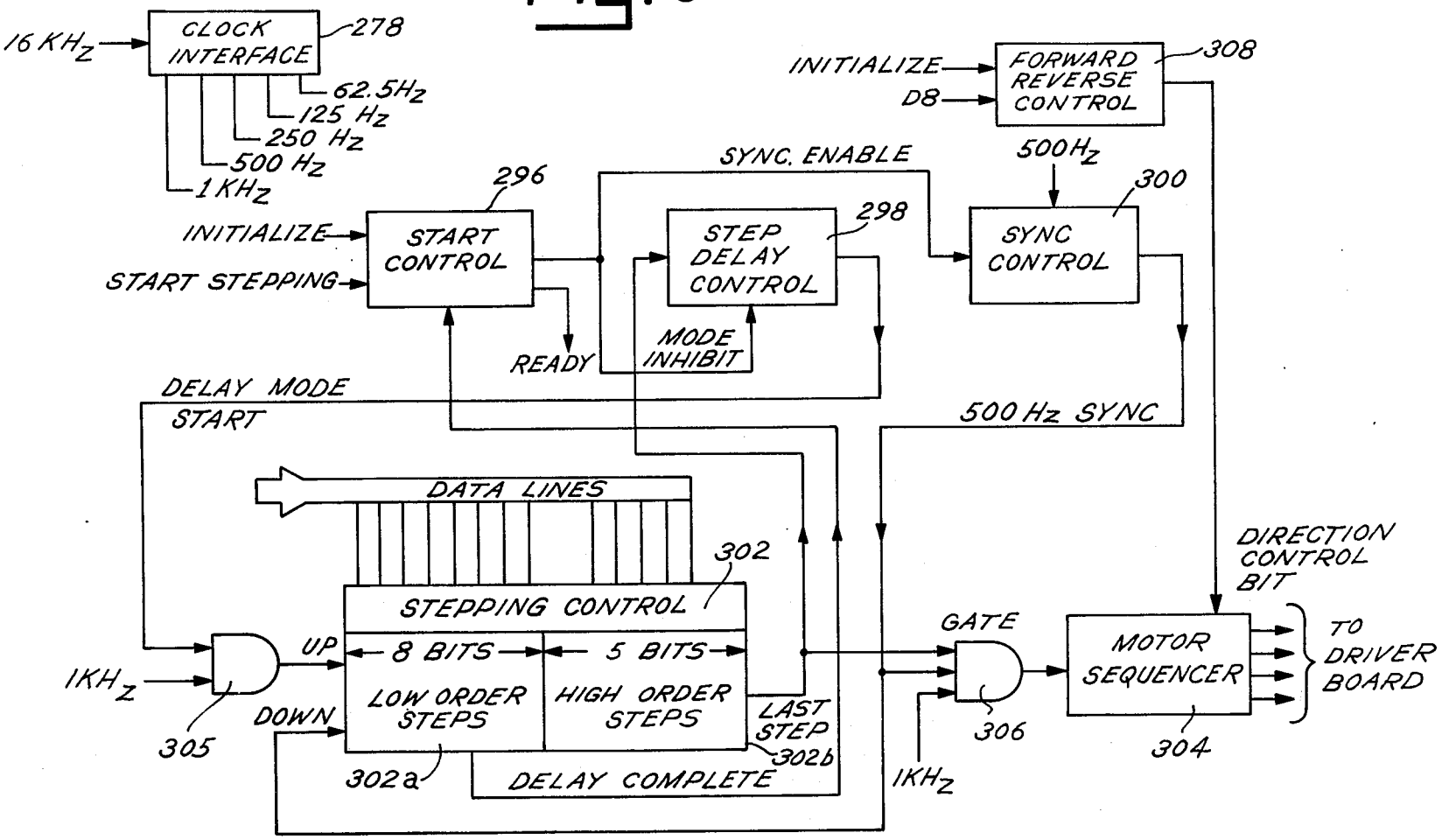
FIG. 5 is a schematic logic diagram of the variator/-collimator lens control circuitry.

Referring now, more particularly, to FIG. 5, operation of the variator lens control circuitry may be more fully understood. At this point, it should be noted that the collimator lens control circuit is identical to that for the variator lens, with the exception that the stepping control for the collimator lens includes single order stepping within the stepping control. Basically, both the variator and collimator lens control circuitry control the sequence of events from the initial call for steps of the lens carriage until the last step has been taken and the settling delay has been completed.

A start control 296 initializes the sequence when an "Initialize" command is received. When a "Start Stepping" command is received by control 296, it releases the inhibit signal to Step/Release control 298 and at the same time enables Sync Control 300 to provide sync pulses, preferably of 500 Hz. These pulses are utilized by stepping control 302 and motor sequencer 304 to begin movement of the variator lens. When the total number of steps have been outputted from the stepper control 302, a "Last Step" signal is provided to the step/relay control 298 to start the delay mode. This signal terminates step pulses to the stepping control and now directs delay pulses until the delay time has been completed. The stepping control then sends a "Delay Complete" signal to start control 296 which resets the logic. At this time a "Ready" signal is made available by the start control to the data bus. It will be appreciated that once the sequence is set and the variator (or collimator) lens is moving, the receipt of a subsequent "Initialized" command will terminate the sequence to the start control 296. This stops the variator lens and start control 296 will generate a Ready signal, whereby the control is placed in a mode waiting for new data.

Stepping control 302 includes two groups of control counters 302*a* and 302*b*, respectively. Group 302*a* is capable of inputting eight bits of data when "Initialize" command is received. These eight bits being of low order. Group 302*b* receives five bits of data when a "Start Stepping" command is received, with these five bits being of high order.

It will be appreciated that when a "Start Stepping" command is received, it enables sync control 300 to input pulses to the "Down" counting input stepping control 302. The "Last Step" pulse inhibits gate 306, whereby further pulses are not transferred to motor sequencer 304. It also changes the sequence of the delay mode, thereby enabling a 1 KHZ pulse train to be passed through gate 305 to the "Up" count input of the stepping control. When the value of 32 is reached, a "Delay Complete" pulse is generated by the stepping control to the start control 296, whereby the sequence is completed and the logic is returned to a "Wait" state.

Gate 306 receives the 500 HZ sync pulses, together with a 1 KHZ signal, whereby the output of the gate is a signal of 500 HZ, with a positive pulse width of a 1 KHZ square wave. This signal serves as a clock for a Gray Code Generator through motor sequencer 304. A forward/reverse control 308 provides direction signals to sequencer 304 which determines the sequence of the Gray Code Output. The Gray Code associated with sequencer 304 converts each input pulse from gate 306 into one motor step of the proper sequence (forward or reverse). These input pulses may be terminated in two ways:

(1) By completing the total number of steps to be taken ("last step" pulse), or (2) By receipt of an "Initialize" low order command.

It will be appreciated that the Stepper Board is also provided with appropriate Input/Output control logic for furnishing information to the data bus. This information would include data defining the conditions of the variator and collimator home switches, plus the status of the variator, collimator and leading motors.

As mentioned above, the conventional methods for setting up photocomposition machines of this type were complex, time-consuming and costly. This was due primarily to variances in lens parameters, such as focal length, and mechanical variances inherent within the lens mounting and associated mechanism. Set up procedures for such machines also required that the home position switches or other sensors be mounted at precise trip locations in order to assure proper focussing and magnification. This procedure was time-consuming in itself since the position of each switch housing was not necessarily the same as the trip location, due to variances between the actuator and switch contacts. Mechanical variances are also inherent within the carriage drive mechanism and stepper motors. These often cause inaccurate positioning of the lenses resulting in poor focussing and improper magnification.

The method and apparatus of the present invention provide a relatively simple means of utilizing a given set of lenses with a given photocomposition machine since such compensates for variances in both lenses and machine parameters. The present invention may be more fully understood by referring to FIG. 3 of the drawing. The variator lens serves as prime magnification control. As this lens is moved to various longitudinal positions relative to a fixed object (Disc 12), aerial images of commensurate magnification occur at respective image locations. The distance from the object to the first aerial image is indicated by the letter "I" in FIG. 3. The distance from the object to the variator lens nodal is indicated by the dimension "$V_p+X$".

The position of the first aerial image with respect to the object may be defined by the Gaussian equation:

$$I=(F(M_V+1)^2/M_v \quad (1)$$

where $M_v$=Variator magnification at desired image size, and

F=Focal length of the variator.

The position of the variator lens as a function of magnification may be defined by the equation:

$$V_p+X=F(M_v+1)/M_v \quad (2)$$

where

X=The distance of the variator home switch from the object, and $V_p$=Distance of the variator from its home position switch.

It follows from Equation (2) that the variator position may be expressed as:

$$V_p=(F(M_v+1)/M_v-X \quad (3)$$

It will be appreciated that the collimator/decollimator lens combination has the additional function of providing a fixed magnification base for the entire lens system. Numerically, this is the ratio of the decollimator focal length to the collimator focal length. The magnification of the overall system is the product of the variator magnification ($M_v$) and collimator/decollimator magnification, which is denoted as $M_c$. The variator magnification at a desired point size may be expressed as:

$$M_v=P/(M_c)(S_m) \quad (4)$$

where

P=Selected image point size, and $S_m$=Object character size on storage disc.

In order to achieve the desired magnification, as well as maintain suitable focus quality, it is necessary to locate the variator and collimator lenses in precise longitudinal positions relative to the object. As the variator lens is moved longitudinally, the first aerial image is shifted longitudinally along the optical path. In order to achieve proper focussing, it is necessary that the collimator lens be positioned from the first aerial image a distance equal to its focal length. The position of the collimator lens is referenced to its home position switch and may be expressed in terms of motor steps from the home switch. For the purposes of the control system, the collimator position is expressed by the following equation:

$$C_p=C_o-F[(M_v+1)^2/M_v-4] \quad (5)$$

where $C_o$=Collimator steps from the home switch at 1:1 magnification of variator.

Equations (3), (4) and (5) are the basic focus algorithms for the lens system. The CPU is provided with an appropriate program which makes in process calculation of $M_v$, $V_p$ and $C_p$ for each selected image point size. The values for F, X, $M_c$, and $C_o$, which may be referred to as system parameters, are determined empirically with the lenses mounted in the machine. It will be appreciated that these parameters take into consideration variances in lens parameters, such as focal length, and mechanical variances within the lens control mechanism including the home position switches. Once these parameters have been determined empirically, they are stored in a memory associated with the CPU and are used by the on-line program to compute the positions of the lenses as a function of selected character image size.

Figure 3:
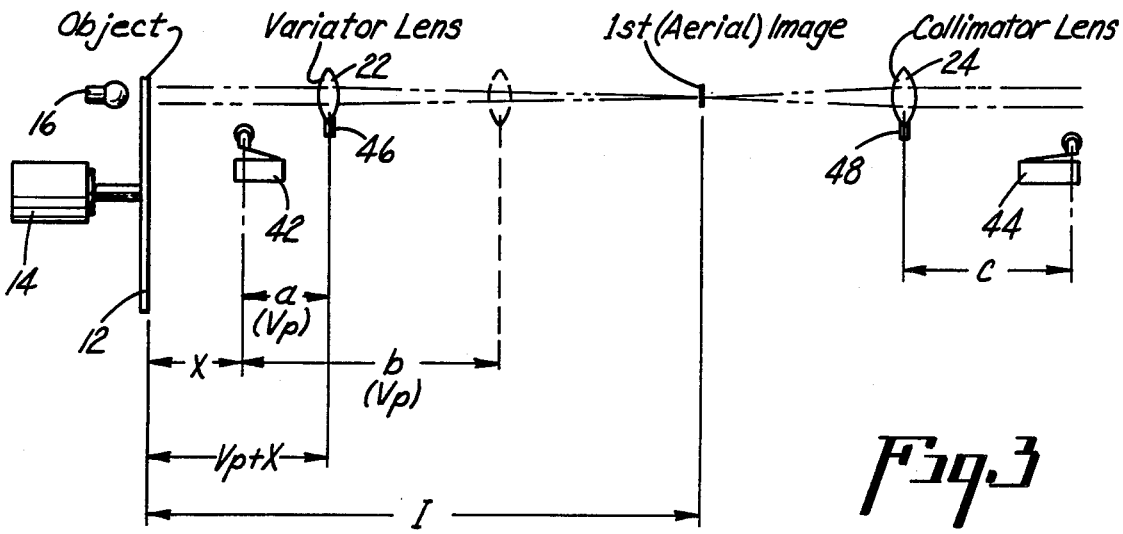
FIG. 3 is a schematic diagram of the lens system illustrating various measurements associated with the method of the present invention.

The preferred embodiment of the method of the present invention which is used to determine the values for the system parameters entails measurements at two variator positions while maintaining the collimator at a fixed location. The lenses are mounted in the machine and the collimator lens is moved from its home switch a predetermined number of steps. This is some optimum location which is known to provide focussing during set up so long as the lens and machine parameters are within acceptable tolerances. As the collimator lens carriage is moved from its home position, the number of motor steps is recorded with the aid of a test program or other appropriate means. With the collimator lens at a position $C_a$, the variator lens is stepped from its home position until a focussed image is provided on the photosensitive paper. In the actual set up procedure this is achieved by exposing the photosensitive paper with a series of images, each corresponding to a different variator position. This is done in a variator lens position range known to produce a focussed image so long as the lens and machine variances are within expected tolerances. Each image corresponds to a variator lens position which may be expressed in terms of steps (or other command data) from the variator home position switch. The best focussed image is selected from the test paper and the corresponding variator lens position is recorded. This indicated by the dimension "a" is shown in FIG. 3. In addition, the size of the focussed image is measured on the test paper and is recorded for subsequent calculations.

With the collimator lens held at the same position, the variator lens is moved until a second focus condition is achieved. This is indicated by the dimension "b". At this position of the variator lens, the first aerial image is at the same location, thereby providing a focussed image on the photosensitive paper. The position of the variator lens in terms of motor steps is recorded and the size of the focussed image is measured from the test paper and recorded for subsequent calculations.

Using these five empirical measurements, namely, a, b, $C_a$, and the two image sizes ($S_a$ and $S_b$), the four system parameters may be calculated. Each of the parameters may be defined algebraically in terms of the empirical measurements or other quantities which may be arrived at as a result of the measurements.

The value of $M_c$, magnification ratio contributed by the collimator/decollimator lens combination, may be calculated from the following equation:

$$M_c=\sqrt{S_a\times S_b/S_m} \quad (6)$$

Equation (6 ) may be arrived at by the following algebraic computation:

$$M_a=MA/M_c=1/M_b=1/MB/M_c=M_c/MB$$

It follows that:

$$M_c^2=MA\times MB,$$

where $MA=S_a/S_m$=System magnification ratio with variator at "a,"

$MB=S_b/S_m$=System magnification ratio with variator at "b".

Substituting in the above equation, one arrives at:

$$M_c^2=S_a/S_m\times S_b/S_m;$$

$$M_c=\sqrt{S_a\times S_b/S_m}$$

The variator focal length F may be calculated from the following equation:

$$F=\sqrt{S_aS_b}(b-a)/S_b-S_a \quad (7)$$

This equation may be arrived at by the following algebraic computations:

$$b+X=\frac{F(M_b+1)}{M_b},$$

-continued $$a + X = \frac{F(M_a + 1)}{M_a},$$

$$a - b = F\left[\frac{(M_a + 1)}{M_a} - \frac{(M_b + 1)}{M_b}\right],$$

$$F = \frac{a - b}{\left[\frac{(M_a + 1)}{M_a} - \frac{(M_b + 1)}{M_b}\right]},$$

$$F = \frac{M_a M_b (a - b)}{M_b - M_a},$$

$$\text{where } M_a = \frac{\sqrt{S_a S_b}}{S_b},$$

$$M_b = \frac{\sqrt{S_a S_b}}{S_a},$$

$$F = \frac{\frac{S_a S_b}{S_a S_b}(a - b)}{\frac{\sqrt{S_a S_b}}{S_a} - \frac{\sqrt{S_a S_b}}{S_b}}$$

The trip position of the variator home switch from the character disc cannot be measured in terms of actual motor steps since the disc is in the path of lens movement. Therefore, it is determined algebraically from the following equation:

$$X = \frac{(b - a)}{(S_a - S_b)}\left[\sqrt{S_a S_b} + S_b\right] - a. \quad (8)$$

This expression is arrived at from the basic Gaussian equation:

$$X + a = F(M_a + 1)/M_a,$$

and by substituting $$M_a = \sqrt{S_a S_b}/S_b$$

$$M_b = \sqrt{S_a S_b}/S_a.$$

System parameter $C_o$, which is the number of collimator steps from the home switch for proper focussing with the variator magnification ratio at 1:1, may be expressed by the equation:

$$C_o = F[(M_a + 1)^2/M_a - 4] + C_a \quad (9)$$

where $C_a$ = Collimator steps from the home switch with the variator at magnification ratio $M_a$.

The value $C_a$ is actually counted and recorded during the initial set up. The value for $M_a$ may be determined by the equation:

$$M_a = \sqrt{S_a S_b}/S_b$$

by inserting the measured image size values.

The above described procedure is merely exemplary of the set up procedure associated with the present invention. If desired, other empirical measurements may be utilized to calculate the above system parameters. For example, under some circumstances it may be desirable to take measurements with the collimator lens at different positions. The calculations would still take into consideration both lens and machine variances so long as the lens positions are measured in terms of the motor steps or other appropriate position command data.

In the actual machine developed, each step is a very small increment, such that each motor has a range of several thousand steps. In a typical lens-machine combination the empirically determined parameters, F, $C_o$, $M_c$, and X, will usually be high numerical values. It would require a large random access (RAM) or programmable read only memory (PROM) for storing such values. This would be a significant cost factor in the price of the overall machine.

One of the unique features of the present invention is the provision of a relatively inexpensive means of storing the system parameters without using a large RAM or PROM. It was found that the system parameters vary within certain ranges for various lens-machine combinations. For example, the focal length F of a given variator lens may vary between 975 and 1010 motor steps. This value may be expressed in terms of a variance from some base value such as the average value, or expected low value, for all variator lenses from a group of lenses of known quality. The variance value may be expressed in terms of a plus or minus value. In the preferred embodiment of the present invention, a ROM is provided which contains data representative of the base values for the system parameters. After the actual parameter values have been determined, the variance values are calculated and stored as binary data in a group of manually settable switches commonly called "DIP" switches. With the actual machine developed, the variant data requires a total of 16 bits, with F requiring 5 bits, $C_o$—4 bits, $M_c$—2 bits, and X—5 bits.

It will be appreciated that this arrangement is relatively inexpensive compared to the cost of a RAM of sufficient size to accommodate storage-of the determined parameter value. Furthermore, it provides an extremely simple means of storing the parameter data in an assembly line procedure without the use of complex programming procedures. The operation of the machine is such that when a point size change is made by the operator, the program combines the variant and base data for each parameter and applies such to the lens position algorithms.

Figure 4:
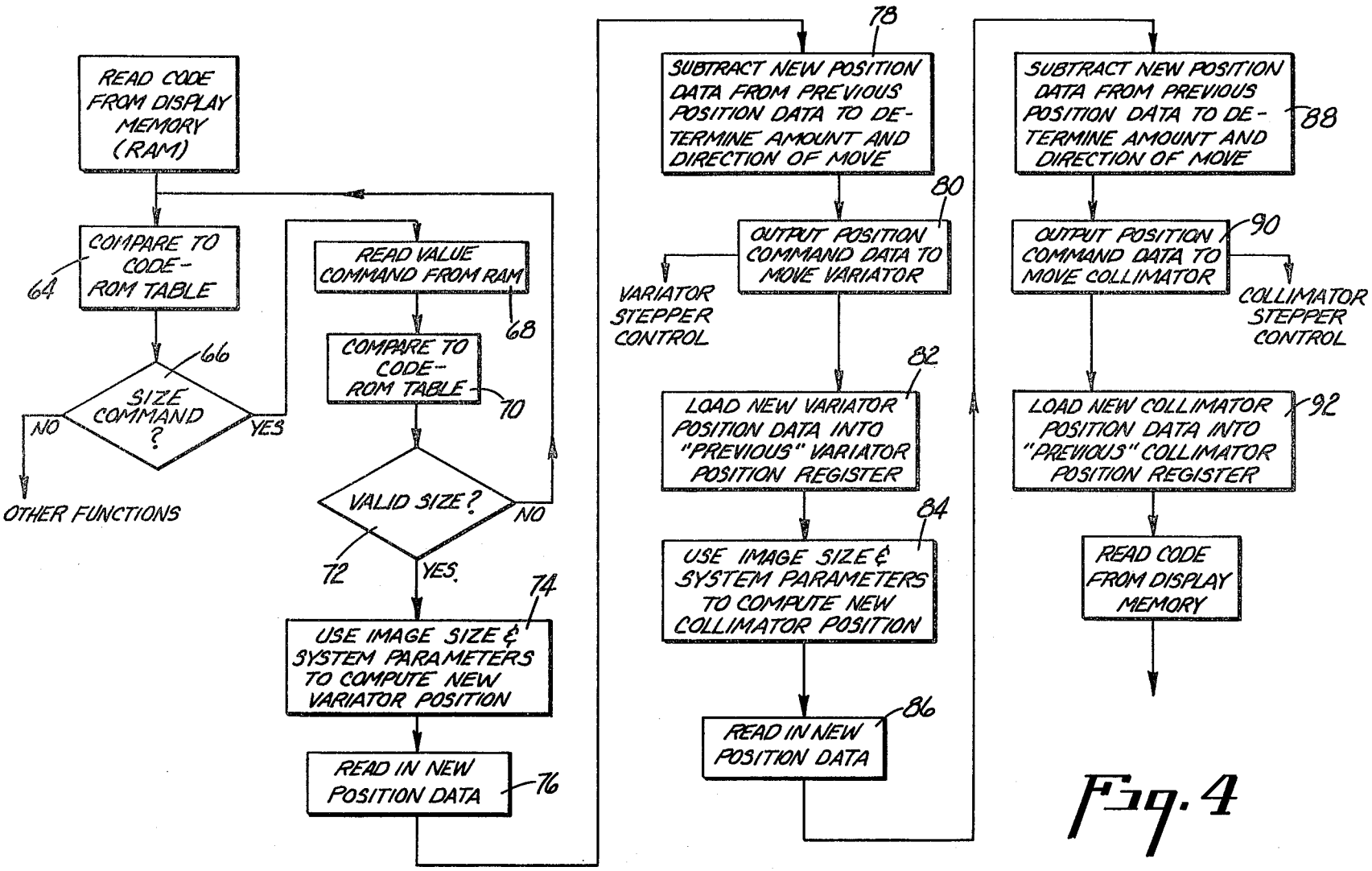
FIG. 4 is a flow chart showing a typical variator/collimator control program routinely associated with the present invention.

As mentioned above, the CPU is provided with an on-line program which calculates by the above algorithms the lens position data as a function of selected point size and the previously stored system parameters. Each time the operator selects a new point size, these calculations are made by the on-line program which results in position command data for moving the lenses to a new position. FIG. 4 is a simplified flow chart of the variator/collimator lens position routine associated with such an on-line program.

The CPU is provided with a look-up table in RAM for converting the keyboard code to CPU code. As the CPU looks at the data stored in the RAM it continuously compares the codes, as indicated diagrammatically by block 64. Upon recognition of a point size command, as indicated by block 66, the program will proceed with the routine. On the other hand, if there is no point size command present in the RAM, the program will perform various other functions.

When a point size command is recognized, the point size value associated with the command is read from the display memory. This operation is indicated by block 68. Since this point size value is in keyboard code, such is converted into CPU code via a ROM look-up table indicated functionally at 70. The program further checks to see if the point size value is a "Valid Size," as it is possible that the operator may accidently enter numbers which do not fall within the range of acceptable point size values, in which event, the routine is terminated by a decision indicated by block 72. If the point size value is "Valid," such is applied to the algorithm $V_p=[F(M_v+1)/M_v]-X$ to compute the "New" variator position data. This is indicated by blocks 74 and 76.

The current position of the variator lens is stored in a register, or the like, associated with the CPU. This data is described as the "Previous" select lens position data as it corresponds to the previously desired position. The position data corresponding to the newly desired position is referred to as the "New" position data. The program determines the difference between the "New" and "Previous" position data and the direction in which the variator lens carriage must be moved. This operation is indicated diagrammatically by block 78. The difference data is outputted in the form of position command data as indicated by block 80.

The "Position Command Data" is used by the program to provide signals to the variator stepper control, whereby the variator carriage is stepped in accordance with the above description. The "New" variator position data is loaded into a CPU register, as indicated by block 82, to provide the "Previous" position data when the program executes the next routine in response to detection of a new point size command in the display memory.

After providing the output to the variator stepper control, the above routine proceeds in a similar manner to provide position command data for the collimator lens. The point size value is applied to the algorithm $C_p=C_o-F[[(M_v+1)^2/M_v]-4]$to compute the "New" collimator position data, as indicated by blocks 84 and 86. The "Previous" position data for the collimator lens carriage is stored in an appropriate register, or the like, associated with the CPU. The program determines the difference between the "New" position data and the "Previous" position data to provide "Position Command Data" (block 88), which is outputted to the collimator stepper control, as indicated by block 90. The "New" collimator position data is then loaded into the register provided for the "Previous" collimator position as indicated by block 92. The program then refers back to the RAM to repeat the routine or perform other functions in response to commands recognized in the memory.

It will be appreciated the the routine may be modified to provide control of a lens system employing lens other than the variator and collimator lenses disclosed. For example, a zoom lens system may be employed to provide the desired magnification, with the control program changing the relative positions or conditions of the zoom lenses.

From the foregoing description, it will be appreciated that the present invention provides a relatively simple and inexpensive means of utilizing a given set of lenses with a given photocomposition machine. The unique procedure for determining the system parameters requires only five empirical measurements. Furthermore, the determined parameters take into consideration manufacturing variations in both the lenses and the associated control mechanism. The use of "DIP" switches for storage of the variance data associated with the parameter results in a significant cost savings compared with the use of a RAM or PROM for parameter storage.

It will be appreciated also that since the system computes each lens position, rather than reading such from a look-up table, an unlimited number of image sizes may be accommodated. Furthermore, the system is not limited to the use of standard point sizes and any image size value may be accommodated so long as it is within a range acceptable to the system. Thus, special applications may be provided for without making changes to the lens position algorithms or associated program routines.

The lens position algorithms and associated programs may also be used for lens systems providing much larger magnification ranges. for example, lenses having different focal lengths may be installed in a machine for special customer applications. This would change the system parameters values, but would not entail modifications to the basic lens position algorithms and associated programs.

It is not intended that the present invention be limited to the use of the specific system parameters described above or to the specific method for empirically determining the parameter values. It is foreseeable that other parameters and set up procedures may be utilized which take into consideration both lens and machine variances and it is intended that such be encompassed in the scope of the present invention. It will also be understood that the above description of the present invention is susceptible to other various modifications, changes and adaptations, and the same are intended to be comprehended within the meaning and range of equivalence of the appended claims.

What is claimed is:

1. A photocomposition machine having a collimating and decollimating lens system wherein said decollimating lens is driven in a composition path through escapement steps, characterized in that an aerial image is provided to said collimating lens by a variable focus lens positioned to project an illuminated character to an aerial image located along an optical path passing through the variable focus lens, collimating lens and decollimating lens, means for moving said variable focus lens parallel to the optical path relative to a character font for providing an aerial image of preselected size, processor means responsive to the preselected size for selecting the proper positions for the collimating lens and variable focus lens; and stepper means for moving in discrete steps the collimating lens and variable focus lens to the positions selected by the processor means in order to focus the aerial image onto the focal plane of said collimating lens.

2. A machine, as claimed in claim 1, wherein the processor means comprises memory means for enabling the proper lens positions to be selected, said memory means defining a lookup table accessed by the processor means in response to selection of the preselected size.

3. A machine, as claimed in claim 2, wherein the processor means generates position command data representative of the number of discrete steps required to move the variable focus lens and the collimating lens into the positions selected by the processor means.

4. A machine, as claimed in claim 3, wherein the stepper means comprises:

stepper motor means for moving the variable focus lens and collimating lens in discrete steps;

counter means for storing the position command data; and clock means for operating the counter means and enabling the stepper motor means to move the variable focus lens and collimating lens in discrete steps until the counter means attains a predetermined count.

5. In a photocomposition machine including font means for providing at least one font of a plurality of characters, projection light source means for successively illuminating preselected characters of said font means so that the characters are projected along an optical path to a print plane, a photosensitive receiving sheet located in the print plane, and input means for generating point size data representative of the point size of a character selected by an operator for photocomposition from a plurality of available point sizes, improved apparatus for accurately focusing characters at the selected point size onto the receiving sheet comprising:

variator lens means for successively forming a plurality of aerial images representing a plurality of degrees of magnification of said preselected characters by movement of said variator lens means parallel to the optical path into a plurality of different composing positions;

collimator lens means movable parallel to the optical path into a plurality of different composing positions in which the aerial image forms an object image for the collimator lens means, so that collimated light rays are formed;

decollimator lens means responsive to the collimated light rays for focusing a print image corresponding to the aerial image on the receiving sheet and for moving parallel to the optical path to provide escapement for the preselected characters;

processor means for selecting from the point size data the proper composing positions for the variator lens means and the collimator lens means in order to focus characters onto the receiving sheet at the selected point size; and stepper means for moving the variator lens means and the collimator lens means to the proper composing positions in discrete steps in response to the selecting of the processor means.

6. Apparatus, as claimed in claim 5, wherein the processor means comprises memory means for enabling the proper composing positions to be selected, said memory means defining a lookup table accessed by the processor means in response to the point size data.

7. Apparatus, as claimed in claim 6, wherein the processor means generates position command data representative of the number of discrete steps required to move the variator lens means and collimator lens means into the composing positions.

8. Apparatus, as claimed in claim 7, wherein the stepper means comprises:

stepper motor means for moving the variator lens means and collimator lens means in discrete steps;

counter means for storing the position command data; and clock means for operating the counter means and enabling the stepper motor means to move the variator lens means and collimator lens means in discrete steps until the counter means attains a predetermined count.

* * * * *